US009436197B1

(12) United States Patent
Tang et al.

(10) Patent No.: US 9,436,197 B1
(45) Date of Patent: Sep. 6, 2016

(54) ADAPTIVE OPAMP COMPENSATION

(71) Applicant: Marvell International Ltd., Hamilton (BM)

(72) Inventors: Qiang Tang, Cupertino, CA (US); Chen Ma, Alviso, CA (US); Bo Wang, Sunnyvale, CA (US)

(73) Assignee: Marvell International Ltd., Hamilton (BM)

( * ) Notice: Subject to any disclaimer, the term of this patent is extended or adjusted under 35 U.S.C. 154(b) by 321 days.

(21) Appl. No.: 13/857,662

(22) Filed: Apr. 5, 2013

Related U.S. Application Data

(60) Provisional application No. 61/621,283, filed on Apr. 6, 2012.

(51) Int. Cl.
*G05F 1/565* (2006.01)
*G05F 1/575* (2006.01)

(52) U.S. Cl.
CPC ..... *G05F 1/565* (2013.01); *G05F 1/575* (2013.01)

(58) Field of Classification Search
CPC ..... G05F 1/575; G05F 1/56; G05F 1/565
USPC ..... 323/273–281
See application file for complete search history.

(56) References Cited

U.S. PATENT DOCUMENTS

| | | | | |
|---|---|---|---|---|
| 8,169,203 | B1 * | 5/2012 | Vemula | 323/273 |
| 2005/0127885 | A1 * | 6/2005 | Jung | H03F 1/38 323/282 |
| 2007/0241730 | A1 * | 10/2007 | Dow | G05F 1/575 323/280 |
| 2009/0289724 | A1 * | 11/2009 | Hu et al. | 331/16 |
| 2012/0038332 | A1 * | 2/2012 | Lin | 323/277 |
| 2012/0154064 | A1 * | 6/2012 | Kaczynski | 331/1 R |
| 2013/0069608 | A1 * | 3/2013 | Gakhar | G05F 1/575 323/273 |

* cited by examiner

*Primary Examiner* — Fred E Finch, III
*Assistant Examiner* — Gustavo Rosario Benitez

(57) ABSTRACT

Aspects of the disclosure provide a circuit having an amplifier and a load current based control circuit. The amplifier is configured to detect a difference between a feedback voltage and a reference voltage, and control, based on the difference, a pass device to regulate an output voltage for supplying power to load devices. The feedback voltage is indicative of the regulated output voltage from the pass device. The load current based control circuit is configured to sense a load current output from the pass device to the load devices and generate a control signal to adjust a compensation capacitance based on the sensed load current to adjust a zero frequency of the circuit.

21 Claims, 5 Drawing Sheets

ADAPTIVE OPAMP COMPENSATION

INCORPORATION BY REFERENCE

This present disclosure claims the benefit of U.S. Provisional Application No. 61/621,283, "ADAPTIVE OPAMP COMPENSATION" filed on Apr. 6, 2012, which is incorporated herein by reference in its entirety.

BACKGROUND

The background description provided herein is for the purpose of generally presenting the context of the disclosure. Work of the presently named inventors, to the extent the work is described in this background section, as well as aspects of the description that may not otherwise qualify as prior art at the time of filing, are neither expressly nor impliedly admitted as prior art against the present disclosure.

Operational amplifiers are used in many applications, and stability is one of the concerns that circuit designers have to face. In an example, an operational amplifier is used in a low drop out (LDO) voltage regulator. In the LDO voltage regulator, the operational amplifier compares a feedback voltage from the regulator output with a reference voltage, and controls a pass device based on the comparison to maintain a relatively constant output voltage at the regulator output. Generally, the LDO voltage regulator includes a compensation capacitor that couples the regulator output with the operational amplifier to make the LDO voltage regulator relatively stable.

SUMMARY

Aspects of the disclosure provide a circuit having an amplifier and a load current based control circuit. The amplifier is configured to detect a difference between a feedback voltage and a reference voltage, and control, based on the difference, a pass device to regulate an output voltage for supplying power to load devices. The feedback voltage is indicative of the regulated output voltage from the pass device. The load current based control circuit is configured to sense a load current output from the pass device to the load devices and generate a control signal to adjust a compensation capacitance based on the sensed load current to adjust a zero frequency of the circuit.

In an embodiment, the load current based control circuit is coupled with the amplifier and the pass device into a compensation loop to sense the load current and adaptively adjust the compensation capacitance. In an example, the load current based control circuit includes a low pass filter configured to filter the control signal and shape a bandwidth of the compensation loop.

According to an aspect of the disclosure, the load current based control circuit is configured to reduce the compensation capacitance when the load current increases. In an example, the load current based control circuit is configured to increase the zero frequency of the circuit when the load current increases. In another example, the load current based control circuit is configured to increase the zero frequency of the circuit when a pole frequency of the amplifier is dominant.

Aspects of the disclosure provide a method. The method includes controlling, in a voltage regulator circuit, a pass device to regulate an output voltage for supplying power to load devices, sensing a load current output from the pass device to the load devices, and generating a control signal to adjust a compensation capacitance based on the sensed load current to adjust a zero frequency of the voltage regulator circuit.

Aspects of the disclosure provide a voltage regulator having a pass device, a feedback circuit, an amplifier, a compensation capacitor circuit and a load current based control circuit. The pass device is configured to generate an output voltage for supplying power to load devices based on an unregulated power supply. The feedback circuit configured to generate a feedback voltage indicative of the output voltage. The amplifier is configured to detect a difference between the feedback voltage and a reference voltage, and control, based on the difference, the pass device to regulate the output voltage. The compensation capacitor circuit is configured to provide a zero frequency for the voltage regulator. The load current based control circuit is configured to sense a load current output from the pass device to the load devices and generate a control signal to adjust a compensation capacitance of the compensation capacitor circuit based on the sensed load current to adjust the zero frequency of the voltage regulator.

BRIEF DESCRIPTION OF THE DRAWINGS

Various embodiments of this disclosure that are proposed as examples will be described in detail with reference to the flowing figures, wherein like numerals reference like elements, and wherein.

DETAILED DESCRIPTION OF EMBODIMENTS

Figure 1:
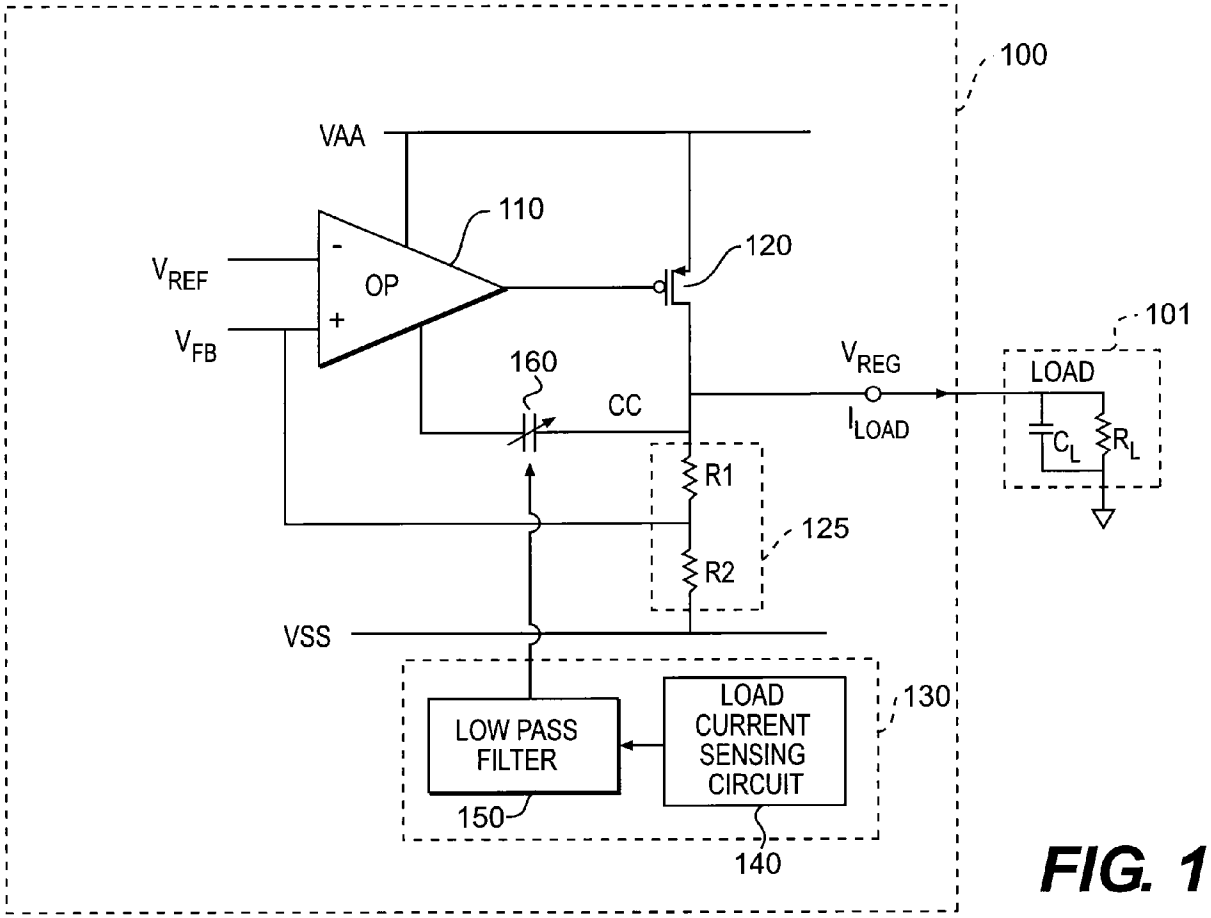
FIG. 1 shows a block diagram of a voltage regulator example 100 according to an embodiment of the disclosure.

FIG. 1 shows a block diagram of a voltage regulator example 100 according to an embodiment of the disclosure. The voltage regulator 100 provides a regulated voltage $V_{REG}$ to power load devices 101. In an embodiment, the regulated voltage $V_{REG}$ is relatively constant and is independent of variations in process, temperature, power supply, and the like. The voltage regulator 100 includes an amplifier 110, a pass device 120, a voltage divider 125, an adjustable capacitor circuit 160, and a load-current based control circuit 130. These elements are coupled together as shown in FIG. 1.

According to an aspect of the disclosure, in order to make the voltage regulator 100 stable for providing the regulated voltage $V_{REG}$ to various load devices 101, the load-current based control circuit 130 adjusts the adjustable capacitor circuit 160 based on a load current $I_{LOAD}$ that flows from the pass device 120 to the load devices 101.

In the FIG. 1 example, the amplifier 110, the pass device 120 and the voltage divider 125 form a feedback loop to maintain the regulated voltage $V_{REG}$ to be relatively constant. For example, the voltage regulator 100 receives a supply voltage VAA and operates based on the supply voltage VAA. In an example, the supply voltage VAA is unregulated. For example, the supply voltage VAA is directly output from a battery, and may vary from battery to battery and from time to time. The pass device 120 passes a current from the supply voltage VAA under the control of the amplifier 110 to provide the regulated voltage $V_{REG}$.

In an example, the voltage divider 125 generates a feedback voltage $V_{FB}$ based on the regulated voltage $V_{REG}$. For example, the voltage divider 125 includes two resistors R1 and R2 coupled in series to scale the regulated voltage $V_{REG}$ and generate the feedback voltage $V_{FB}$. Thus, the feedback voltage $V_{FB}$ is proportional to the regulated voltage $V_{REG}$.

Further, the amplifier 110 receives the feedback voltage $V_{FB}$ and a reference voltage $V_{REF}$ that is relatively stable. In an example, the reference voltage $V_{REF}$ is generated based on a silicon band-gap voltage, and can be considered as a constant voltage that is independent of process, temperature, and voltage supply. The amplifier 110 detects a different between the feedback voltage $V_{FB}$ and the reference voltage $V_{REF}$, and controls the pass device 120 in a manner to reduce the difference to be about zero, such that the regulated voltage $V_{REG}$ is locked with reference to the reference voltage $V_{REF}$, such as being locked to $V_{REF}\times(1+R1/R2)$.

When the regulated voltage $V_{REG}$ shifts from the locked voltage for any reason, the amplifier 110 controls the pass device 120 to counteract the voltage shift. In an example, when the voltage $V_{REG}$ increases from the locked voltage for some reasons, the feedback voltage $V_{FB}$ also increases. The amplifier 110 detects that the feedback voltage $V_{FB}$ is larger than the reference voltage $V_{REF}$, and controls the pass device 120 to reduce the voltage $V_{REG}$. In an example, the voltage regulator 100 is a low drop out (LDO) regulator, and the pass device 120 is a power transistor, such as a P-type metal-oxide-semiconductor field-effect transistor (MOSFET) power transistor that can have a relatively low voltage drop. The amplifier 110 increases a gate voltage of the P-type MOSFET transistor 120 when the feedback voltage $V_{FB}$ is larger than the reference voltage, and thus reduces the regulated voltage $V_{REG}$.

When the regulated voltage $V_{REG}$ decreases from the locked voltage for some reasons, the feedback voltage $V_{FB}$ also decreases. The amplifier 110 detects that the feedback voltage $V_{FB}$ is smaller than the reference voltage $V_{REF}$, and decreases the gate voltage of the P-type MOSFET transistor 120 to increase the voltage regulated $V_{REG}$.

According to an embodiment of the disclosure, the voltage regulator 100 is configured to be relatively stable under various load situations. In the FIG. 1 example, the load devices 101 are modeled as a capacitive load ($C_L$) and a resistive load ($R_L$) coupled together. The capacitive load $C_L$ and/or the resistive load $R_L$ can vary in a wide range from application to application. Even in a same application, the capacitive load $C_L$ and the resistive load $R_L$ can vary. The voltage regulator 100 is configured to be stable to work with the wide range of the capacitive load $C_L$ and the wide range of the resistive load $R_L$. In an example, the phase margin of the voltage regulator 100 is maintained in a safe range, such as larger than 50° for the wide range of capacitive load $C_L$ and the wide range of the resistive load $R_L$.

According to an aspect of the disclosure, the gain and phase characteristics of the voltage regulator 100 depend on the capacitive load $C_L$ and the resistive load $R_L$. In an example, the transfer function of the voltage regulator 100 has several poles, such as a dominant pole with a lowest pole frequency, a second pole, a third pole and the like. In an example, when the load current $I_{LOAD}$ is relatively small, the resistive load $R_L$ is large, and the dominant pole is a function of the resistance load $R_L$ and the capacitive load $C_L$. When the load current $I_{LOAD}$ is relatively large, the resistive load $R_L$ is small, the dominant pole is determined by the amplifier 120 and is fixed, and the second pole is a function of the resistance load $R_L$ and the capacitive load $C_L$. In an example, when the load current $I_{LOAD}$ and the capacitive load $C_L$ are large, the voltage regulator 100 may have a worst situation that the phase margin is under 30° when the adjustable capacitor circuit 160 provides a fixed compensation capacitance.

According to an embodiment of the disclosure, the load-current based control circuit 130 is configured to control a capacitance of the adjustable capacitor circuit 160 based on the load current $I_{LOAD}$. In an example, the adjustable capacitor circuit 160 includes a varactor that is implemented using an Ahuja compensation capacitor architecture. The load-current based control circuit 130 provides a control voltage to control the capacitance of the varactor. The capacitance adjustment moves a zero frequency in the transfer function of the voltage regulator 100. In an example, the zero frequency is moved to the high frequency direction when the load current $I_{LOAD}$ increases. The movement of the zero frequency causes the phase margin of the voltage regulator 100 to increase to compensate for the decrease due to the poles movement. Thus, the phase margin of the voltage regulator 100 can stay in a safe range to make the voltage regulator 100 stable.

In an embodiment, the load-current based control circuit 130 includes a load current sensing circuit 140 and a low pass filter 150. The load current sensing circuit 140 is configured to sense the load current $I_{LOAD}$ and generate a control signal, such as a control voltage. The low pass filter 150 filters the control signal and provides the filtered control signal to the adjustable capacitor circuit 160 to adjust the compensation capacitance. In an example, the load current sensing circuit 140, the low pass filter 150, the adjustable capacitor circuit 160, the amplifier 110 and the pass device 120 form a second loop in addition to the feedback loop used for regulating the regulated voltage $V_{REG}$. Because of the low pass filter 150, the second loop has a much smaller bandwidth than the feedback loop, and does not affect the stability of the voltage regulator 100.

According to an embodiment of the disclosure, the voltage regulator 100 is implemented on an integrated circuit (IC) chip. In an example, the load devices 101 are on the IC chip. In another example, the load devices 101 are external to the IC chip. In another embodiment, a portion of the voltage regulator 100 is implemented using off chip components. In an example, the adjustable capacitor circuit 160 is implemented using off chip components. In another example, the pass device 120 is implemented using an off chip transistor.

It is also noted that the voltage regulator 100 can be suitably modified. In an example, the voltage regulator 100 can be suitably modified to use an N-type MOSFET transistor 120. In another example, the voltage regulator 100 can be suitably modified to use one or more bipolar transistors as the pass device 120.

Figure 2:
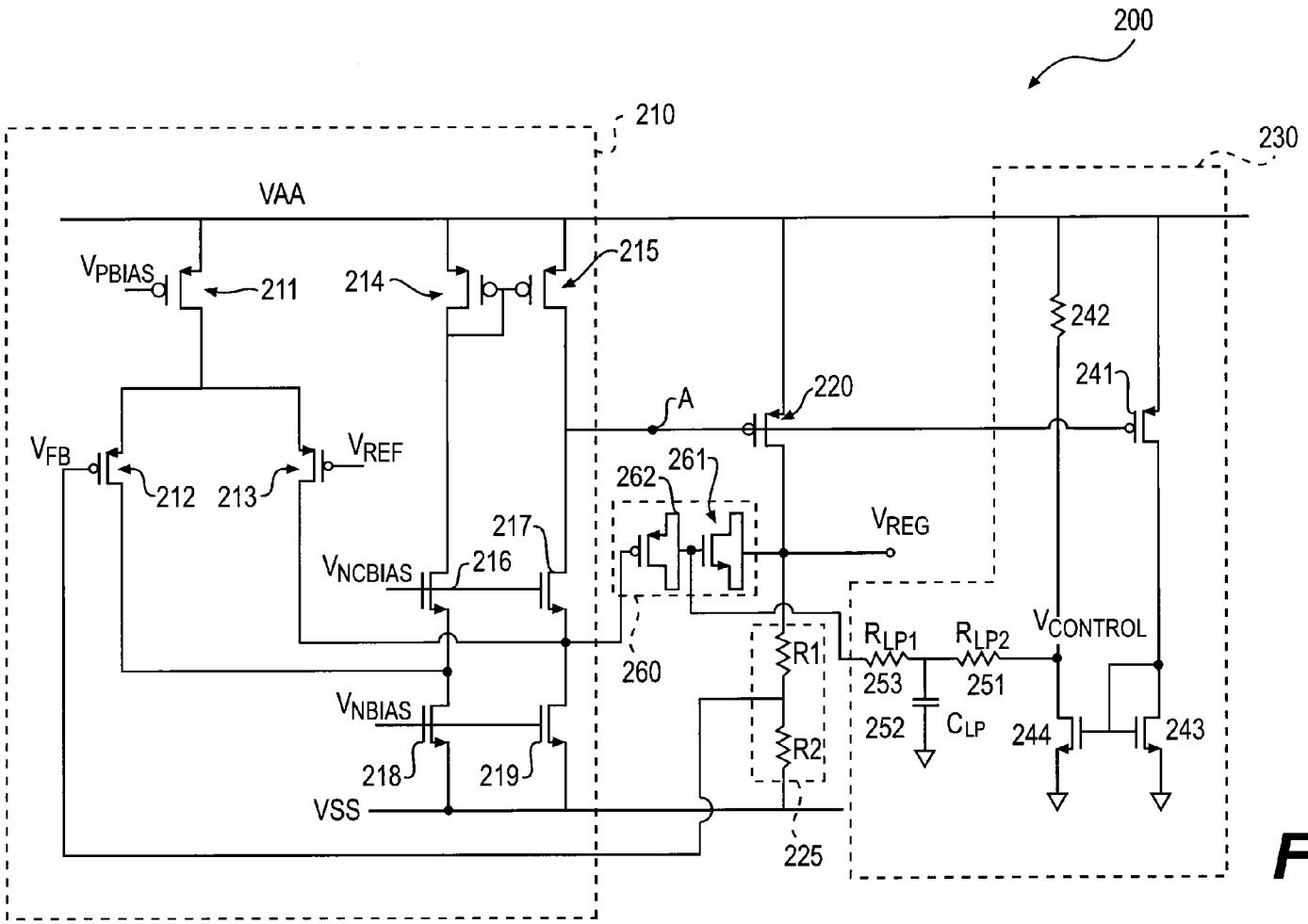
FIG. 2 shows a circuit schematic diagram of a voltage regulator 200 according to an embodiment of the disclosure.

FIG. 2 shows a circuit schematic diagram of a voltage regulator 200 according to an embodiment of the disclosure. The voltage regulator 200 is configured to provide a regulated voltage $V_{REG}$ to load devices (not shown) with reference to a reference voltage $V_{REF}$. The voltage regulator 100 includes an amplifier 210, a pass transistor 220, a voltage divider 225, an adjustable capacitor circuit 260, and a load-current based control circuit 230. These elements are coupled together as shown in FIG. 2.

In the FIG. 2 example, the amplifier 210 includes P-type MOSFET (PMOS) transistors 211-215 and N-type MOSFET (NMOS) transistors 216-219 coupled together in a differential folded cascode operational amplifier topology.

Specifically, the PMOS transistors 212 and 213 are input devices that form a differential pair to respectively receive a feedback voltage $V_{FB}$ and the reference voltage $V_{REF}$. The PMOS transistors 211, 214 and 215 and the NMOS transistors 218 and 219 form current sources. The NMOS transistors 216 and 217 are cascode devices for the current source devices 218 and 219. The amplifier 210 amplifies a difference between the feedback voltage $V_{FB}$ and the reference voltage $V_{REF}$, and generates an amplified output at node A. It is noted that the amplifier 210 can use other suitable topology.

In the FIG. 2 example, the pass transistor 220 is a PMOS transistor. The source terminal of the pass transistor 220 receives an unregulated supply voltage VAA, the gate terminal of the pass transistor 220 is controlled by the amplified output from the amplifier 210, and the drain terminal of the pass transistor 220 outputs the regulated voltage $V_{REG}$.

The voltage divider 225 scales down the regulated voltage $V_{REG}$ to generate the feedback voltage $V_{FB}$. In the FIG. 2 example, the voltage divider 225 is formed by two resistors R1 and R2.

The adjustable capacitor circuit 260 couples the drain terminal of the pass transistor 220 with a join node of the input device 213 and the cascode device 217 and provides a compensation capacitance to the voltage regulator 200. In the FIG. 2 example, the adjustable capacitor circuit 260 includes an NMOS capacitor 261 and a PMOS capacitor 262 coupled together. It is noted that the adjustable capacitor circuit 260 can use other suitable varactor.

The load-current based control circuit 230 is configured to detect a load current flowing through the pass transistor 220, and controls the capacitance of the adjustable capacitor circuit 260 based on the load current. In the FIG. 2 example, the load-current based control circuit 230 includes a current sensing portion and a low pass filter portion. The current sensing portion includes a PMOS transistor 241, NMOS transistors 243 and 244 and a resistor 242. The low pass filter portion includes resistors 251 and 253 and a capacitor 252. These elements are coupled together as shown in FIG. 2.

The PMOS transistor 241 is coupled to the pass transistor 220 in a manner to have the same source-gate voltage as the pass transistor 220. Thus, a sensing current flowing through the PMOS transistor 241 is proportional to the load current flowing through the pass transistor 220. In an example, a ratio of the sensing current to the load current is related to the width/length ratios of the transistors 241 and 220. The NMOS transistors 243 and 244 form a current mirror, such that a current flowing through the resistor 242 mirrors the sensing current. The resistor 242 converts the sensing current to a control voltage $V_{CONTROL}$.

The low pass filter filters the control voltage $V_{CONTROL}$. The filtered control voltage is used to control the capacitance of the adjustable capacitor circuit 260. In an example, the resistances of the resistors 251 and 253 are much larger than the resistances of the resistors R1 and R2, such as ten times larger, thus the compensation loop for adaptively adjusting the compensation capacitance has a much smaller bandwidth than the feedback loop for voltage regulation. Therefore, the compensation loop does not affect the stability of the voltage regulator 200.

During operation, in an example, when the load current increases, the sensing current flowing through the PMOS transistor 241 increases. The increase of the sensing current causes a larger voltage drop on the resistor 242, thus the control voltage $V_{CONTROL}$ decreases. The decrease of the control voltage $V_{CONTROL}$ causes the compensation capacitance of the adjustable capacitor circuit 260 to decrease. The decrease of the compensation capacitance increases the zero frequency of the voltage regulator 200.

According to an aspect of the disclosure, when the load current is relatively large, the dominant pole is fixed, and a second pole frequency and the second pole frequency are relatively large and can cause a phase margin reduction. However, because the compensation loop decreases the compensation capacitance when the load current increases, the zero frequency increases. The increase of the zero frequency can cause the phase margin to increase and counteract the phase margin reduction due to the pole frequency changes, and thus the phase margin is maintained in a safe range, such as larger than 45 degree.

Figure 3:
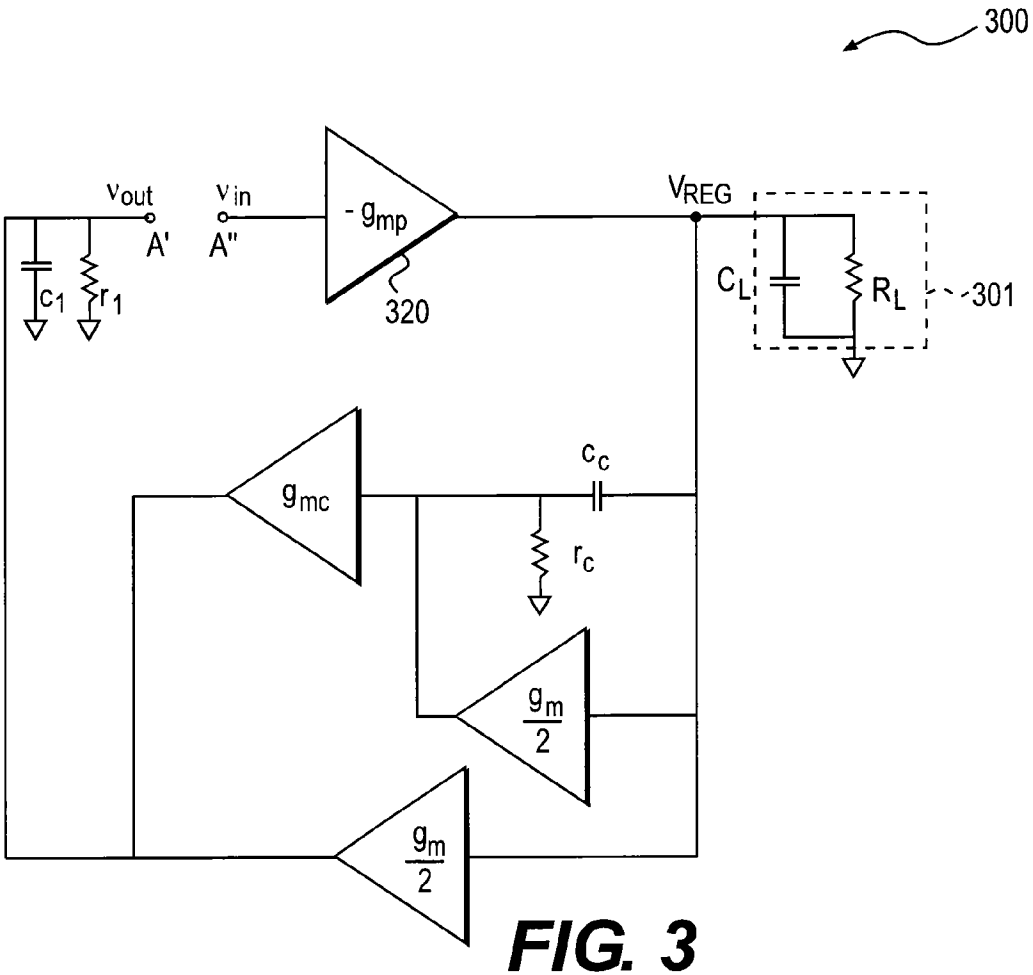
FIG. 3 shows a diagram of a small signal model 300 according to an embodiment of the disclosure.

FIG. 3 shows a diagram of a small signal model 300 for an open loop of the voltage regulator 200 according to an embodiment of the disclosure. The loop of the voltage regulator 200 is opened at the node A, and is represented as A' and A" in FIG. 3. The PMOS transistor 220 is modeled by a transconductance parameter $g_{mp}$. The cascode devices (transistors 216 and 217) are modeled by a resistance parameter $r_c$ and a transconductance parameter $g_{mc}$, and $\tau_g \approx 1/g_{ma}$. The input devices (transistors 212 and 213) are modeled by a transconductance parameter $g_m$, a resistance parameter $r_1$ and a capacitance parameter C1. The compensation capacitance is modeled by $C_C$, and the load devices are modeled by a resistive load $R_L$ and a capacitive load $C_L$.

The small signal gain of the model 300 can be represented in Eq. 1 and the DC gain of the model 300 can be represented in Eq. 2.

$$\frac{v_{out}}{v_{in}} = \frac{-g_{mp} r_1 R_L [s C_c r_c (g_m + 2 g_{mc}) + g_m + g_m g_{mc} r_c]}{2(1 + s C_1 r_1)[s^2 C_c r_c C_L R_L + s(C_c r_c + C_L R_L + C_c R_L + g_m C_c r_c R_L) + 1]} \quad \text{Eq. 1}$$

$$\text{Gain}_{DC} = g_m r_1 g_{mp} R_L \quad \text{Eq. 2}$$

The model 300 has one zero and three poles. The zero frequency ($\omega_z$) is represented in Eq. 3, the first pole frequency (($\omega_{p1}$) is represented by Eq. 4 and the second and third poles frequencies ($\omega_{p2}$ and $\omega_{p3}$) can be determined by solving Eq. 5.

$$\omega_z = \frac{-1}{C_c r_c} \times \frac{g_m}{\frac{g_m}{2} + g_{mc}} \quad \text{Eq. 3}$$

$$\omega_{p1} = \frac{-1}{r_1 C_1} \quad \text{Eq. 4}$$

$$s^2 C_a r_a C_L R_L + s(C_a r_a + C_L R_L + C_a R_L + g_m C_a r_a R_L) + 1 = 0 \quad \text{Eq. 5}$$

Accordingly, the first pole frequency is independent of the load devices, the zero frequency is related to the compensation capacitance and the second and third poles frequencies are related to the load devices.

Figure 4A:
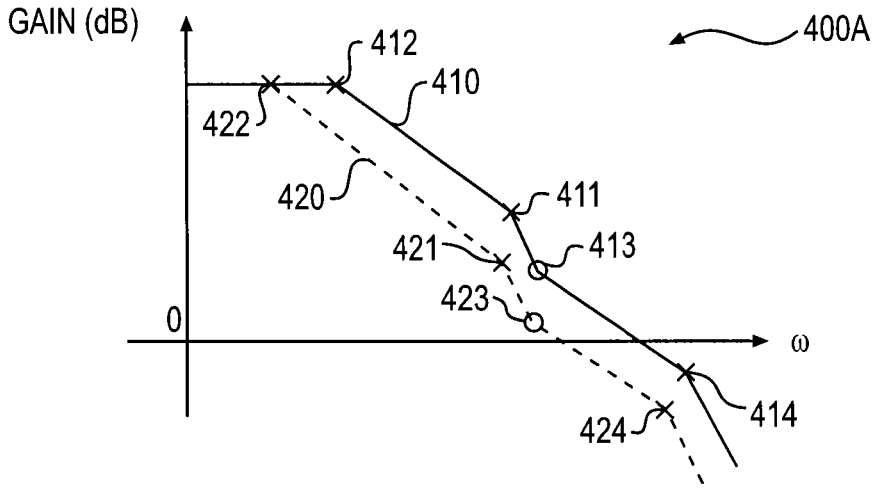
FIGS. 4A and 4B show Bode plots according to an embodiment of the disclosure.
Figure 4B:
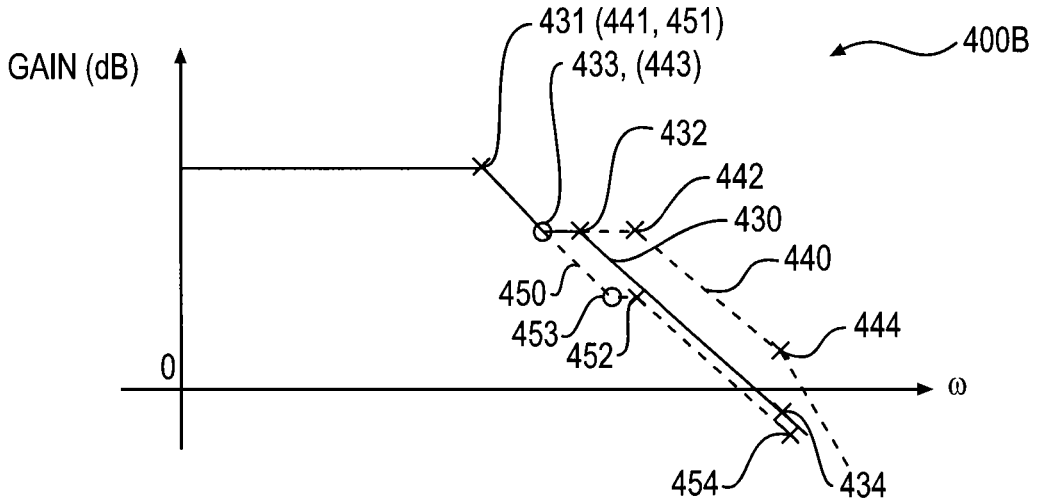

FIG. 4A shows a Bode plot 400A of gain characteristics for the model 300 when the load current is relatively small (relatively large resistive load $R_L$) and FIG. 4B shows a Bode plot 400B of gain characteristics for the model 300 when the load current is relatively large (relatively small resistive load $R_L$) according to an embodiment of the disclosure. In both plots, the X-axis is frequency, and the Y-axis is gain in dB.

The Bode plot 400A includes a first curve 410 and a second curve 420. The first curve 410 corresponds to a gain characteristic with a relatively small capacitive load $C_L$, and the second curve 420 corresponds to a gain characteristic with a relatively large capacitive load $C_L$. The first curve 410 shows the zero 413, the first pole 411, the second pole 412 and the third pole 414. The second curve 420 shows the zero 423, the first pole 421, the second pole 422 and the third pole 424. Because the second pole is dominant (has the lowest frequency) when the load current is relatively small, the unit gain frequency (at 0 dB crossing) is relatively small, and the absolute value of the phase (q) corresponding to the 0 dB crossing is relatively small, for example, about 120. Thus, the phase margin (180°−ϕ) is relatively large, for example, about 60°. The voltage regulator 200 can be relatively stable.

The Bode plot 400B includes a first curve 430, a second curve 440 and a third curve 450. The first curve 430 corresponds to a gain characteristic with a relatively small capacitive load $C_L$, the second curve 440 corresponds to a gain characteristic with a relatively large capacitive load $C_L$, and the third curve 450 corresponds to a gain characteristic when the compensation capacitance $C_C$ is adaptively adjusted based on the load current.

The first curve 430 shows the zero 433, the first pole 431, the second pole 432 and the third pole 434. The second curve 440 shows the zero 443, the first pole 441, the second pole 442 and the third pole 444. The third curve 450 shows the zero 453, the first pole 451, the second pole 452 and the third pole 454.

Because the first pole is dominant (has the lowest frequency) in FIG. 4B, the unit gain frequency is relatively large, and the absolute value of the phase (ϕ) corresponding to the 0 dB crossing is relatively large, and the phase margin (180°−ϕ) can be relatively small and make the voltage regulator 200 less stable. In the FIG. 4B example, a worst case happens when the capacitive load $C_L$ is small as shown by the second curve 440. In an example, the absolute value of the phase (ϕ) corresponding to the 0 dB crossing is more than 150°, and thus the phase margin (180°−ϕ) is smaller than 30°.

As shown by the third curve 450, in an example, because the compensation capacitance $C_C$ is reduced when the load current increases, the zero frequency increases, and the unit gain frequency is reduced. The absolute value of the phase (ϕ) corresponding to the 0 dB crossing is reduced, and the phase margin increases. In an example, the parameters of the adjustable capacitor circuit 260 and the load-current based control circuit 230 are suitably tuned that the phase margin of the voltage regulator 200 remains in a safe region, such as larger than 45°, for a large range of capacitive load $C_L$ and resistive load K.

Figure 5:
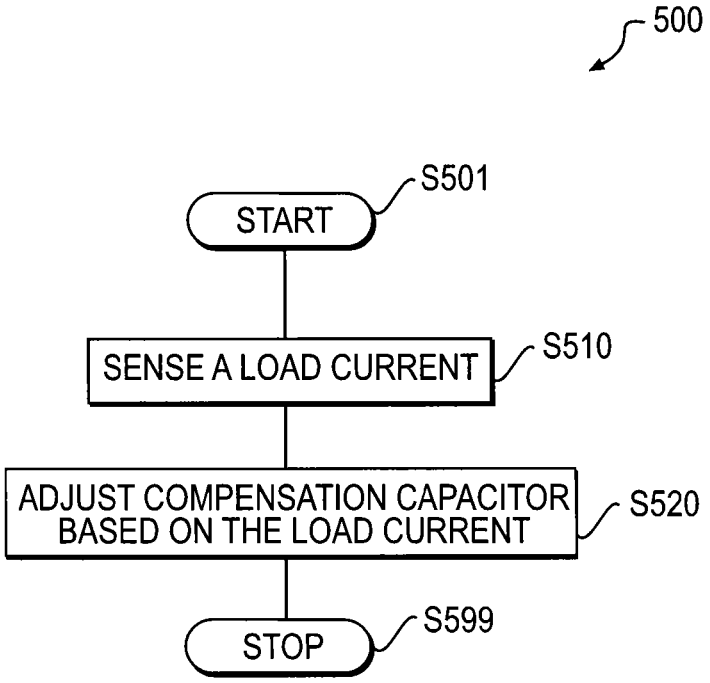
FIG. 5 shows a flowchart outlining a process example 500 according to an embodiment of the disclosure.

FIG. 5 shows a flowchart outlining a process 500 according to an embodiment of the disclosure. The process is performed in a voltage regulator, such as the voltage regulator 100, the voltage regulator 200 and the like. The process starts at 501 and proceeds to S510.

At S510, a load current is sensed. In the FIG. 2 example, the transistor 241 is coupled with the pass transistor 220 to have the same source-gate voltage, thus the current flowing through the transistor 241 is proportional to the load current flowing through the pass transistor 220. Further, the current mirror formed of the transistors 243 and 244 mirrors the current flowing through the transistor 241 to a current flowing through the resistor 242 and generates the control voltage $V_{CONTROL}$.

At S520, an adjustable compensation capacitor is adjusted based on the load current. In an example, when the load current increases, the adjustable compensation capacitor circuit 260 is adjusted to reduce a compensation capacitance. The reduction of the compensation capacitance moves the zero frequency higher. The increase of the zero frequency increases phase margin to compensate for a phase margin reduction due to the pole frequency change with the load current, thus the phase margin of the voltage regulator is remained in a safe range, and the voltage regulator is stable under various load conditions. The process proceeds to S599 and terminates.

While aspects of the present disclosure have been described in conjunction with the specific embodiments thereof that are proposed as examples, alternatives, modifications, and variations to the examples may be made. Accordingly, embodiments as set forth herein are intended to be illustrative and not limiting. There are changes that may be made without departing from the scope of the claims set forth below.

What is claimed is:

1. A circuit, comprising:

an amplifier configured to detect a difference between a feedback voltage and a reference voltage, and control, based on the difference, a pass device to regulate an output voltage for supplying power to load devices, the feedback voltage being indicative of the regulated output voltage from the pass device; and a load current based control circuit configured to sense a load current output from the pass device to the load devices and generate a control signal to adjust a compensation capacitance of a variable capacitor based on the sensed load current to adjust a zero frequency of the circuit, a first terminal of the variable capacitor being directly coupled to one of inputs of the amplifier and a second terminal of the variable capacitor being coupled directly to the pass device.

2. The circuit of claim 1, wherein the load current based control circuit is coupled with the amplifier and the pass device into a compensation loop to sense the load current and adaptively adjust the compensation capacitance.

3. The circuit of claim 2, wherein the load current based control circuit comprises:

a low pass filter configured to filter the control signal and shape a bandwidth of the compensation loop.

4. The circuit of claim 1, wherein the load current based control circuit is configured to reduce the compensation capacitance when the load current increases.

5. The circuit of claim 1, wherein the load current based control circuit is configured to adjust a capacitance of the variable capacitor that is a varactor formed of transistors.

6. The circuit of claim 1, wherein the load current based control circuit is configured to increase the zero frequency of the circuit when the load current increases.

7. The circuit of claim 1, wherein the load current based control circuit is configured to increase the zero frequency of the circuit when a pole frequency of the amplifier is dominant.

8. A method comprising:

controlling, in a voltage regulator circuit, a pass device to regulate an output voltage for supplying power to load devices by an amplifier;

sensing a load current output from the pass device to the load devices; and generating a control signal to adjust a compensation capacitance of a variable capacitor based on the sensed load current to adjust a zero frequency of the voltage regulator circuit, a first terminal of the variable capacitor being directly coupled to one of inputs of the amplifier and a second terminal of the variable capacitor being coupled directly to the pass device.

9. The method of claim 8, wherein generating the control signal to adjust the compensation capacitance based on the sensed load current to adjust the zero frequency of the voltage regulator circuit comprises:

forming a compensation loop to sense the load current and adaptively adjust the compensation capacitance.

10. The method of claim 9, further comprising:

low-pass filtering the control signal to shape a bandwidth of the compensation loop.

11. The method of claim 8, wherein generating the control signal to adjust the compensation capacitance based on the sensed load current to adjust the zero frequency of the voltage regulator circuit comprises:

reducing the compensation capacitance when the load current increases.

12. The method of claim 8, wherein generating the control signal to adjust the compensation capacitance based on the sensed load current to adjust the zero frequency of the voltage regulator circuit comprises:

adjusting a capacitance of the variable capacitor that is a varactor formed of transistors.

13. The method of claim 8, wherein generating the control signal to adjust the compensation capacitance based on the sensed load current to adjust the zero frequency of the voltage regulator circuit comprises:

increasing the zero frequency of the voltage regulator circuit when the load current increases.

14. A voltage regulator, comprising:

a pass device configured to generate an output voltage for supplying power to load devices based on an unregulated power supply;

a feedback circuit configured to generate a feedback voltage indicative of the output voltage;

an amplifier configured to detect a difference between the feedback voltage and a reference voltage, and control, based on the difference, the pass device to regulate the output voltage;

a compensation capacitor circuit configured to provide a zero frequency for the voltage regulator; and a load current based control circuit configured to sense a load current output from the pass device to the load devices and generate a control signal to adjust a compensation capacitance of the compensation capacitor circuit based on the sensed load current to adjust the zero frequency of the voltage regulator, a first terminal of the compensation capacitor being directly coupled to one of inputs of the amplifier and a second terminal of the compensation capacitor being coupled directly to the pass device.

15. The voltage regulator of claim 14, wherein the load current based control circuit is coupled with the compensation capacitor circuit, the amplifier and the pass device into a compensation loop to sense the load current and adaptively adjust the compensation capacitance.

16. The voltage regulator of claim 15, wherein the load current based control circuit comprises:

a low pass filter configured to filter the control signal and shape a bandwidth of the compensation loop.

17. The voltage regulator of claim 14, wherein the load current based control circuit is configured to reduce the compensation capacitance when the load current increases.

18. The voltage regulator of claim 14, wherein the compensation capacitor circuit is a varactor formed of transistors.

19. The voltage regulator of claim 14, wherein the load current based control circuit is configured to increase the zero frequency of the circuit when the load current increases.

20. The voltage regulator of claim 14, wherein the load current based control circuit is configured to increase the zero frequency of the circuit when a pole frequency provided by the amplifier is dominant.

21. A circuit, comprising:

an amplifier configured to detect a difference between a feedback voltage and a reference voltage, and control, based on the difference, a pass device to regulate an output voltage for supplying power to load devices, the feedback voltage being indicative of the regulated output voltage from the pass device; and a load current based control circuit configured to sense a load current output from the pass device to the load devices and generate a control signal to adjust a compensation capacitance of a variable capacitor based on the sensed load current to adjust a zero frequency of the circuit, a first terminal of the variable capacitor being coupled to one of inputs of the amplifier and a second terminal of the variable capacitor being coupled directly to a drain terminal of the pass device.

* * * * *